US005673538A

United States Patent [19]

Wallace et al.

[11] Patent Number: 5,673,538

[45] Date of Patent: Oct. 7, 1997

[54] METHOD FOR DOUBLE FOLDING AN INSULATION BATT

[75] Inventors: Keith Wallace, Corunna, Canada; Charles R. Weir, Westerville, Ohio

[73] Assignee: Owens Corning Canada Inc., North York, Canada

[21] Appl. No.: 769,390

[22] Filed: Dec. 19, 1996

Related U.S. Application Data

[62] Division of Ser. No. 540,629, Oct. 11, 1995, Pat. No. 5,631,061.

[51] Int. Cl.[6] ..... B65B 63/04

[52] U.S. Cl. ..... 53/429; 53/438; 493/458

[58] Field of Search ..... 53/116, 117, 119, 53/120, 429, 438, 439, 528, 529, 530; 493/440, 447, 449, 451, 456, 458

[56] References Cited

U.S. PATENT DOCUMENTS

| | | | |
|---|---|---|---|
| 1,166,737 | 1/1916 | Baird . | |
| 3,161,000 | 12/1964 | Hannon et al. . | |
| 3,526,566 | 9/1970 | McIlvain, Jr. et al. . | |
| 3,691,721 | 9/1972 | Hannon et al. . | |
| 3,919,827 | 11/1975 | Larson et al. | 53/429 |
| 4,106,260 | 8/1978 | King . | |
| 4,218,962 | 8/1980 | Cunningham et al. | 493/416 X |
| 4,439,175 | 3/1984 | Cimochowski et al. | 493/451 X |
| 4,472,923 | 9/1984 | Herrington | 53/429 |
| 4,559,761 | 12/1985 | Kumm et al. | 53/429 X |
| 4,756,945 | 7/1988 | Gibb . | |
| 4,805,374 | 2/1989 | Yawberg . | |
| 4,817,365 | 4/1989 | Yawberg et al. . | |
| 4,833,863 | 5/1989 | Scott et al. . | |
| 4,840,013 | 6/1989 | Perrella | 53/429 |
| 5,493,841 | 2/1996 | Van Wegen et al. . | |

*Primary Examiner*—Daniel Moon

*Attorney, Agent, or Firm*—C. Michael Gegenheimer; Curtis B. Brueske

[57] ABSTRACT

A fibrous insulation batt having a length and a width and including a first and second section, where each section is approximately one half the length of the batt, is folded so that the first section is generally parallel to and contacting the second section. The batt has two folds across its width and located between the first and second sections. The two folds are spaced apart from each other a distance approximately equal to the thickness of the uncompressed insulation batt. The two sections of the batt remain generally parallel to and contact each other when the batt is laid horizontal and in an unrestrained condition.

14 Claims, 3 Drawing Sheets

METHOD FOR DOUBLE FOLDING AN INSULATION BATT

CROSS REFERENCE TO RELATED APPLICATION

This is a division of U.S. patent application Ser. No. 08/540,629, filed Oct. 11, 1995, now U.S. Pat. No. 5,631,061.

TECHNICAL FIELD

This invention relates to the packaging and handling of a length of a fibrous insulation batt by folding the batt and packaging the batt in a folded position.

BACKGROUND ART

Fibrous insulation material is typically manufactured in common lengths and widths, called insulation batts, to accommodate typical building frame structure dimensions. Fibrous insulation batts are commonly made of mineral fibers, such as glass fibers, and usually have a density within the range of from about 0.2 to about 1.0 pounds per cubic foot (3.2 to 16 kg/m$^3$). Typical batt sizes are 16 or 24 inches (40.6 cm or 61.0 cm) wide by 8 feet (2.44 m) long. These bars can be packaged in various ways. The batts can be staggered and rolled together along their lengths so that a roll would contain about 10 batts. Alternatively, the bars can be stacked on top of each other, compressed and then packaged in plastic bags. Because of size constraints it is desirable to fold the bars in half along their lengths and stack them together, thereby forming a stack which is about 4 feet (1.22 m) long. The invention as described herein pertains to the packaging of the folded batts.

Presently, the insulation bars are simply folded in half and deposited horizontally in a stacker which collects the folded bars and packages them. The bars can be folded either manually or by a folding machine which uses a ram to push on the center of the batt and insert the batt into a gap between two conveyors to fold the batt, as described in U.S. Pat. No. 4,805,374 to Yawberg. The folded bars are stacked vertically in the stacker until a certain desired number of batts is accumulated. After a sufficient number of batts has been accumulated in the stacker, the accumulated batts are then compressed and packaged into a plastic bag.

One of the problems with a conventional batt folding and packaging system is that the folded bars have a tendency to unfold by themselves unless they are constrained. The folded bars do not stack well because the bars do not stay folded in an even flat shape. Because the fibrous insulation at the folded end of the batt is under compression, the top section or half of the insulation batt lifts above the bottom section at the unfolded end due to the natural springiness of the insulation. The partially unfolded batt resembles a wedge-shaped figure where the top folded section or half is at an angle to the bottom half. This results in the open end of the folded batt having a greater thickness than the folded end of the batt.

When the wedge-shaped folded batts are stacked on top of each other in the stacker, the accumulation of the increased side thickness causes the stack to lean. This uneven stacking can cause the folded batts to unfold or tip over, thereby jamming the stacker. To prevent batts from unfolding, compressed air is used to force down the top section of the folded batts. The use of the compressed air is only partially effective and has the undesirable qualities of being very noisy, spreading loose insulation fibers and dust into the air, and being very costly.

It would be desirable to have a way of folding lengths of fibrous insulation batts so that they remain folded and are not wedge-shaped when in an unrestrained condition.

DISCLOSURE OF INVENTION

There has now been invented an improved folded insulation batt which remains folded and is generally flat when it is laid horizontal and it is in an unrestrained condition.

The present invention comprises a folded fibrous insulation batt having a length and a width. The batt has first and second sections, each section being approximately one half the length of the batt. The batt is folded so that the first section is generally parallel to and contacting the second section. The batt also has two folds across the width of the insulation batt and located between the first and second sections. The two folds are spaced apart from each other. Preferably, the distance between the two folds is equal to the thickness of the insulation batt when the batt is in an uncompressed condition. When the batt is in an unrestrained condition the two sections of the batt remain generally parallel to and contact each other.

According to this invention, there is also provided a method of folding the fibrous insulation batt. The batt is folded at a first fold across the width of the insulation batt which is located between the first and second sections. The batt is then folded at a second fold across the width of the insulation batt. The second fold is spaced apart from the first fold and located between the first and second sections. The first and second folds fold the insulation batt so that the first section is generally parallel to and contacts the second section. Preferably, the distance between the two folds is equal to the thickness of the insulation batt when the batt is in an uncompressed condition. The folds can be folded separately or at the same time.

Another method for folding the insulation batt is to position the first and second contact elements across the width of the insulation batt and between the first and second sections. The contact elements are spaced apart from each other. The first section is then folded about the lust contact element to create a first fold. Likewise, the second section is folded about the second contact element to create a second fold. The first and second folds fold the insulation batt so that the first section is generally parallel to and contacting the second section. The contact elements can comprise rods which extend across the entire width of the batt or extend partly across the width of the batt. The contact elements can also be edges of curved plate. The concave side of the plate lies against the insulation batt.

In a specific embodiment of the invention, the insulation batt is temporarily compressed with a roller prior to folding. The batt is compressed in a compression zone, which is located generally in the center of the length of the batt. The compression zone of the batt is temporarily compressed prior to folding to reduce the tendency of the folded batt to unfold.

BEST MODE FOR CARRYING OUT THE INVENTION

Figure 1:
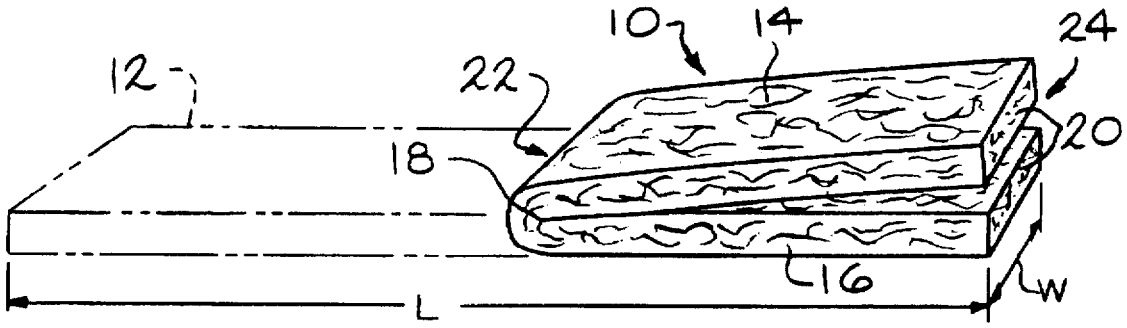
FIG. 1 PRIOR ART
FIG. 1 is a perspective view of a prior art folded insulation batt having a single fold.

There is illustrated in FIG. 1 a prior art folded insulation batt generally indicated at 10. Although the batt is shown in the folded position, the unfolded position is shown by phantom lines 12. The batt is folded in half along its length L and across its width W. The batt is folded so that a top section 14 of the batt rests on a bottom section 16. The prior art batt is folded at a single crease or fold 18 which is located between the two sections. When the batt is in an unrestrained condition, as it is in FIG. 1, it partially unfolds. The ends 20 of the batt are spread apart, which results in the batt's having a wedge-shaped figure. This is due to the single fold which causes the insulation material surrounding the fold to be compressed. The compressed insulation has an inherent springiness which lifts the top section from the bottom section. The result is a folded batt having a smaller thickness on a folded end 22 than on the open or unfolded end 24. This uneven shape results in poor stacking when folded batts are stacked on top of each other.

Figure 2:
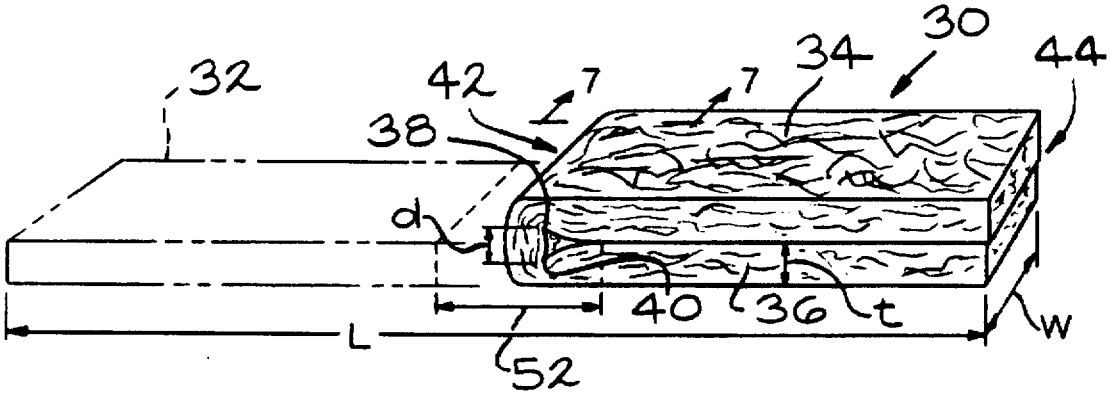
FIG. 2 is a perspective view of a folded insulation batt of the present invention.

The folded insulation batt of the present invention is indicated generally at 30, in FIG. 2. Preferably, the batt is made of glass fibers, and has a density of about 0.5 pounds per cubic foot (8 kg/m$^3$), although the invention is applicable to insulation batts of a wide variety of fibrous materials, and having a wide variety of densities. The batt's unfolded position is indicated by the phantom lines 32. As in the prior art batt 10, the batt 30 of the invention is folded along its length L and across its width W, and has first and second sections which are defined as top section 34 and bottom section 36. The batt is folded at two folds 38 and 40, thereby forming a dual-folded batt. The folded batt has a folded end 42 and an open or unfolded end 44.

The two folds reduce the tendency of the top section to lift or spring up from the bottom section. The compressed insulation is distributed in two fold areas, instead of one as in the prior art batt. At each fold the compressed insulation is not completely bent over on itself but only partially bent. By distributing the compression of the insulation over two folds the batt does not have enough springiness to lift the top section above the bottom section and the batt is kept folded by the weight of the top section alone. Also, the thickness at the folded end 42 is increased so that the thickness of the folded batt is more uniform when comparing the folded end to the unfolded end, in contrast to a single folded batt where the two ends are not of the same thickness. Therefore, in an unrestrained condition where there are no other forces acting upon the dual-folded batt, the top section is generally parallel to the bottom section and the two sections are contacting or resting upon each other when the batt is folded.

The two folds 38 and 40 are spaced apart from each other by distance d. The preferred distance d is within the range of from about 0.4 to 1.5 times the thickness t of the batt in the uncompressed condition. Preferably the distance d is about the thickness t of the batt. A batt packaging machine adapted to fold batts of varying thickness can have the folds spaced apart about 3 inches (7.6 cm) for thin bars, for example, a 3 inch thick batt (7.6 cm), and folds spaced apart 8 inches (20.3 cm) for thicker bars, for example, a 9 inch (22.9 cm) thick batt. It has been found that if the folds are too close to each other the advantage of having two folds is not significant, and the folded batt resembles a single folded batt. The closely spaced folds would be too compressed or stiff and the compressed insulation in the top and bottom sections would force the top section away from the bottom section. If the distance d is too large, the folded end becomes too unstable and the top section can shift with respect to the bottom section.

Figure 3A:
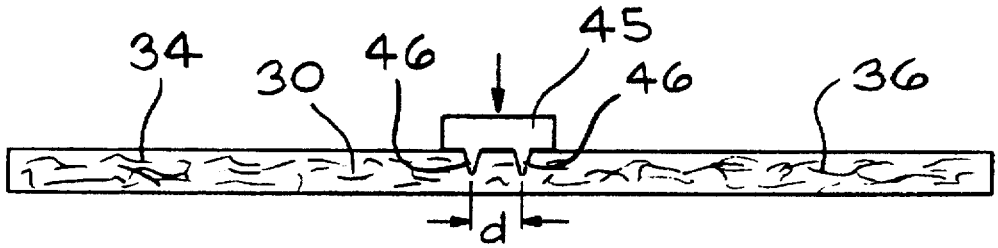
FIG. 3A is a side view of a folding die forming two creases on an insulation batt.
Figure 3B:
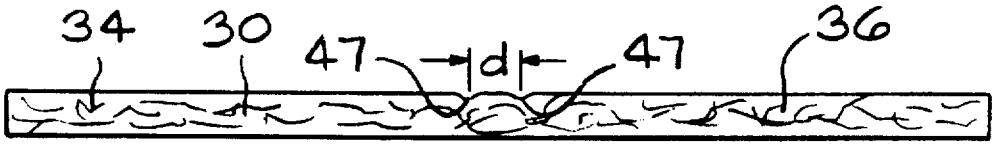
FIG. 3B is a side view of the insulation batt of FIG. 3A having two cresses.

The two folds can be created by various methods. One method is to use a folding die 45 having two contact elements 46, as shown in FIG. 3A. The contact elements are spaced apart from each other the desired distance d where the two folds are to be created. The folding die is lowered onto the insulation batt and the two protruding contact elements compress the insulation across the width of the batt, as shown in FIG. 3A. The folding die is then raised above the batt, by hand or by means not shown, leaving two slightly compressed creases 47 across the width of the batt, as shown in FIG. 3B. The batt is then folded either manually or by a machine at the creases, forming a dual-folded batt.

Figure 4:
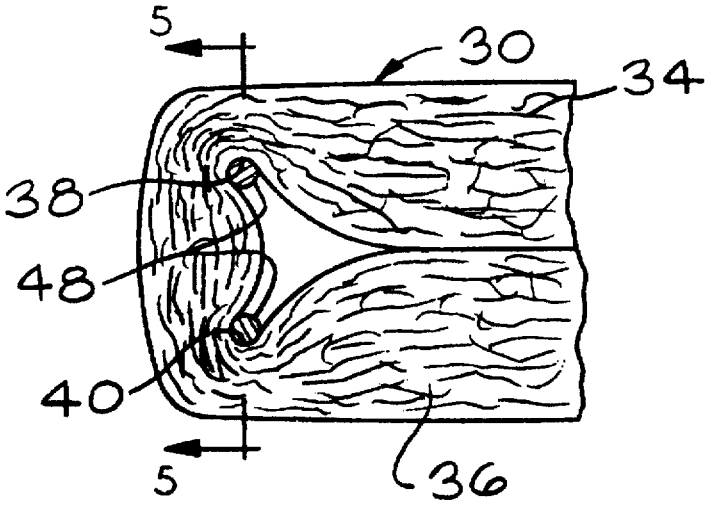
FIG. 4 is a cross-sectional view of the insulation batt being folded by two rods.
Figure 5:
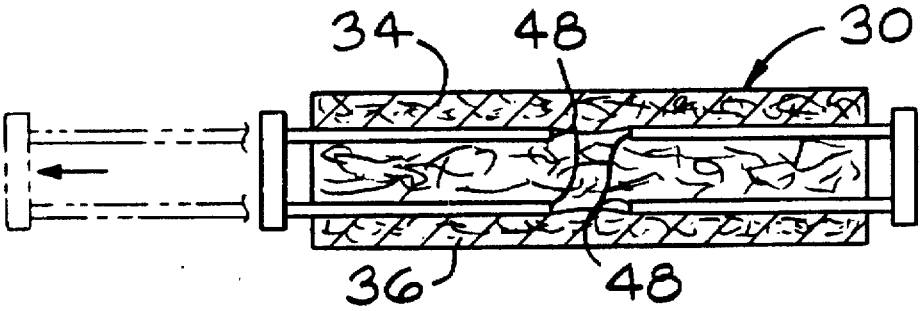
FIG. 5 is a cross-sectional view of the insulation batt of FIG. 4, taken along lines 5—5.

Another method of forming the dual-folded batt is to use a folding machine similar to the batt folder described in U.S. Pat. No. 4, 805,374 in which a ram contacts the center of the batt and forces the batt into a new direction and between two conveyors. The method of the invention involves having a ram or contact member with two contact elements which can be laid across the width of the batt so that when the batt is folded the two folds are created. Any contact member having two spaced apart contact elements extending along the width of the batt is sufficient for folding the batt. FIG. 4 illustrates contact elements in the form of rods 48, shown in cross-section, which extend across the width of the batt, and which are positioned at a desired distance d apart from each other. After the rods are positioned, the top and bottom sections 34 and 36 are folded around the rods. The sections can be folded either separately or at the same time. When the rods are removed, the batt will have two folds at the locations that were contacted by the rods. For convenience in removing the rods from the folded batt, two pairs of rods can be used, as shown in FIG. 5 in phantom lines, and each pair of rods can be removed laterally from the sides of the folded batt. It is not necessary to have the rods extend the entire width of the batt.

Figure 6:
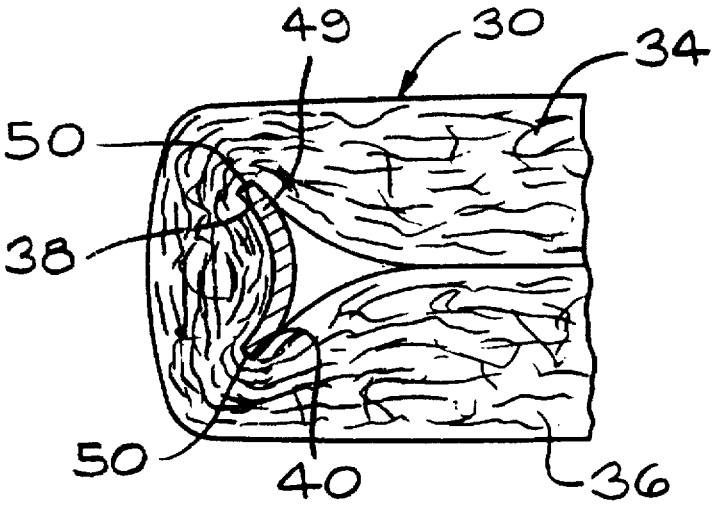
FIG. 6 is a cross-sectional view of another embodiment of the insulation batt being folded by a curved plate.

FIG. 6 illustrates another embodiment in which the contact member is a curved plate 49 having two ends 50 which are used as the contact elements. The curved plate is positioned so that the concave side lies against the batt. This concave surface allows for the expansion of the insulation that is compressed between the folds.

Figure 7:
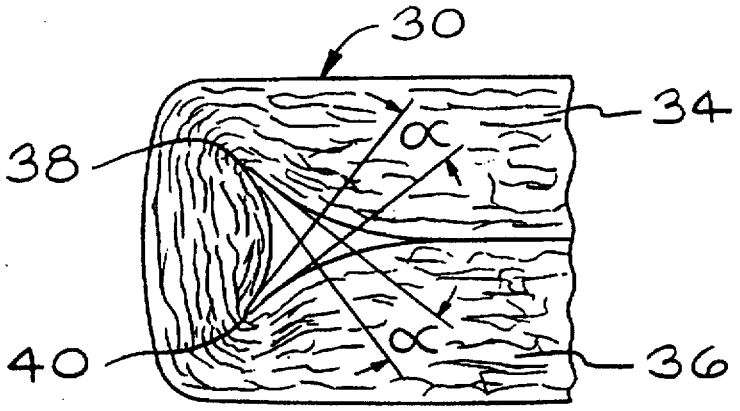
FIG. 7 is a cross-sectional view of the insulation batt taken along lines 7—7 from FIG. 2.

The folded batt of the invention having two folds is very distinct from the single folded batt of the prior art. FIG. 7 shows the two folds having relatively the same angle when the folded batt is lying flat. It can be seen that the insulation surrounding the folds is compressed. Preferably, the angles of the folds are roughly the same so that the least amount of insulation will be compressed at the folds. If the angles are not the same, one fold will be folded at a smaller or tighter angle and will compress the insulation more than the other fold. This would increase the tendency of the batt to unfold.

Figure 8:
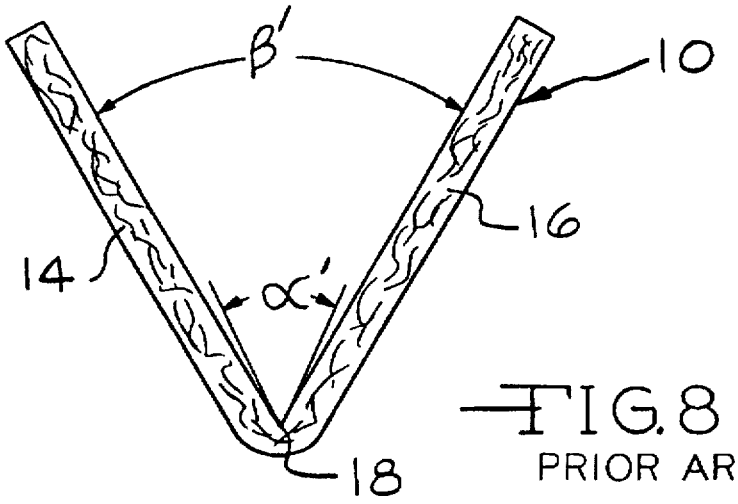
FIG. 8 PRIOR ART
FIG. 8 is a side elevational view of a prior art insulation bar having a single fold and shown spread apart.
Figure 9:
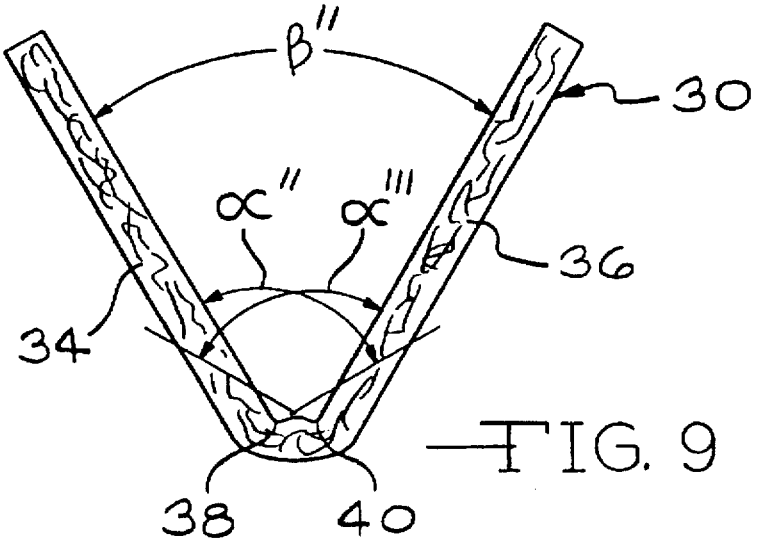
FIG. 9 is a side elevational view of the folded insulation batt of the present invention, shown spread apart.

One of the characteristics of the insulation bans is that when the batt is unfolded, the folds and their related angles can be examined. As shown in FIG. 8 with the prior art batt, the single fold 18 forms an angle α' when the first and second sections are partially unfolded. The spreading apart of the first and second sections form an opened angle β'. When the opened angle β' is within the range of from about 60 to about 120 degrees, the fold angle α' will be approximately equal to the opened angle β'. As shown in FIG. 9, when the first and second sections of the dual-folded batt are spread apart, an opened angle β" is formed. When the opened angle β" is within the range of from about 60 to 120 degrees, the two folds 38 and 40 will each form angles α" and α'", respectively, and are approximately equal to the opened angle β".

An insulation batt which has two folds has several advantages over the single folded batt. By staying folded in an unrestrained condition, the dual-folded batt is easier to handle and move either by workers manually or on a conveyor system. Also, the bans stay folded when put into a stacker of a packaging machine which collects the folded bans and packages them. The folded batts are stacked vertically until a desired number of bans have been accumulated in the stacker. The dual-folded bans stack well because of having a generally fiat shape and the stack will not lean or tip over and cause the stacker to jam.

Another advantage of the dual-folded batt is that it enables thicker butts to remain folded. Absent the invention, thick butts would not remain folded. For example, a butt having a thickness of 9 inches (22.9 cm) can be folded with two folds according to the invention, and will remain folded even when unrestrained. Prior to the invention a butt having a thickness of 7 inches (17.8 cm) was about the maximum thickness of a single folded batt which would stay folded when unrestrained.

Temporarily compressing the insulation prior to folding is a common procedure that is done to the batt. The insulation batt can be compressed with a roller or inserted between moving parallel conveyors to "soften" the fibers in the batt. This reduces the tendency of the folded batt to unfold. Softening breaks down some of the insulation fibers and some of the fiber-to-fiber bonds; resulting in an insulation product which is not as stiff and does not recover back to its optimum height. Thus, the resistance to unfolding is not as great in softened fibers as in unsoftened fibers. However, the softening decreases the recovery height of the batt after unpackaging. Therefore, in the preferred form of the invention only a small portion of the batt is softened. This small portion is defined as a compression zone 52, and is illustrated in FIG. 1. The compression zone covers the area of the batt which is under compression when the batt is in a folded condition. The compression zone is located generally in the center of the length of batt and has a length within the range of from about 4 to about 20 inches (10.2 cm to about 50.8 cm). By limiting the softening procedure to the compression zone rather than the entire length of the batt, an improvement in recovery of up to 10 percent or greater can be achieved. Because of the improved folding characteristics of the dual-folded batt, belts which are low density or are thin may not require softening, and only the double folding may be necessary to prevent the batt from unfolding.

Another advantage of the dual-folded batt as compared to the single-folded batt, is that the dual-folded batt has a greater stiffness as determined by measuring the angle of the cantilevered portions of a four foot length of a batt when the batt is draped over a fulcrum. The stiffness of the dual-folded batt is better than the single-folded batt because the dual-folded batt is only affected by softening and folding at the folded area of the batt. The first and second sections are generally untouched by either the softening or the folding. The softening and folding damages the insulation batt so that the unfolded batt is not as stiff as it is in its original condition. High values of stiffness are important product attributes of insulation products.

It will be evident from the foregoing that various modifications can be made to this invention. Such, however, are considered as being within the scope of the invention.

INDUSTRIAL APPLICABILITY

The invention can be useful in the packaging and handling of a length of a folded fibrous insulation batt.

We claim:

1. A method for folding a fibrous insulation batt, the batt having a length and a width, the batt having a first and second section, the method comprising:

a. folding the insulation batt at a first fold across the width of the insulation bar, with the first fold being located between the first and second sections; and b. folding the insulation batt at a second fold across the width of the insulation batt, the second fold being spaced apart from the first fold and located between the first and second sections, the first and second folds folding the insulation batt so that the first section is generally parallel to and contacts the second section, the distance between the two folds being within the range of from about 0.4 to 1.5 times the thickness of the insulation batt when the batt is in an uncompressed condition.

2. The method of claim 1 in which the first and second sections are folded at the same time.

3. The method of claim 1 further comprising temporarily compressing the insulation batt prior to folding to reduce the tendency of the folded batt to unfold.

4. The method of claim 3 in which the insulation batt is temporarily compressed with a roller.

5. The method of claim 3 in which the insulation batt has a compression zone which is located generally in the center of the length of the batt, the compression zone having a length within the range of from about 4 to about 20 inches (10.2 cm to about 50.8 cm), and in which the compression zone of the batt is temporarily compressed prior to folding to reduce the tendency of the folded batt to unfold.

6. A method for folding a fibrous insulation batt, the batt having a length and a width, the batt having a first and second section, the method comprising:

a. positioning first and second contact elements across the width of the insulation batt and between the first and second sections, the contact elements being spaced apart from each other;

b. folding the first section about the first contact element to create a first fold and folding the second section about the second contact element to create a second fold, the first and second folds folding the insulation batt so that the first section is generally parallel to and contacts the second section, the distance between the two folds being within the range of from about 0.4 to 1.5 times the thickness of the insulation bar when the batt is in an uncompressed condition.

7. The method of claim 6 in which the first and second contact elements each comprise a rod extending across the width of the batt.

8. The method of claim 6 in which the first and second contact elements each comprise a pair of rods extending partly across the width of the batt.

9. The method of claim 6 in which the first and second contact elements are the edges of a plate.

10. The method of claim 9 in which the plate is curved having a concave side, the concave side lying against the insulation batt.

11. The method of claim 6 further comprising temporarily compressing the insulation batt prior to folding to reduce the tendency of the folded batt to unfold.

12. The method of claim 11 in which the insulation batt is temporarily compressed with a roller.

13. The method of claim 11 in which the insulation batt has a compression zone which is located generally in the center of the length of the batt, the compression zone having a length within the range of from about 4 to about 20 inches (10.2 cm to about 50.8 cm), and in which the compression zone of the batt is temporarily compressed prior to folding to reduce the tendency of the folded batt to unfold.

14. The method of claim 6 in which the first and second sections are folded at the same time.

* * * * *

UNITED STATES PATENT AND TRADEMARK OFFICE

CERTIFICATE OF CORRECTION

PATENT NO. : 5,673,538

DATED : October 7, 1997

INVENTOR(S) : Keith Wallace, Charles R. Weir

It is certified that error appears in the above-identified patent and that said Letters Patent is hereby corrected as shown below:

In Claim 1, line 5, "bar" should be - -batt- -.

In Claim 6, line 15, "bar" should be - -batt- -.

Signed and Sealed this

Twenty-first Day of April, 1998

Bruce Lehman

*Attest:*

BRUCE LEHMAN

*Attesting Officer*

*Commissioner of Patents and Trademarks*